US006615591B1

(12) United States Patent
Kusada et al.

(10) Patent No.: US 6,615,591 B1
(45) Date of Patent: Sep. 9, 2003

(54) CRYOGENIC REFRIGERATION SYSTEM

(75) Inventors: Shigehisa Kusada, Aichi (JP); Tomoyuki Motoyoshi, Aichi (JP); Yoshinao Sanada, Kanagawa (JP); Keiji Tomioka, Osaka (JP)

(73) Assignees: Central Japan Railway Company, Nagoya (JP); Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/289,291

(22) Filed: Nov. 7, 2002

(30) Foreign Application Priority Data

May 20, 2002 (JP) ..... 2002-144653

(51) Int. Cl.[7] ..... F25B 19/02
(52) U.S. Cl. ..... 62/51.2; 62/335
(58) Field of Search ..... 62/51.2, 335, 51.1

(56) References Cited

U.S. PATENT DOCUMENTS 4,766,741 A * 8/1988 Bartlett et al. ..... 62/51.2
5,060,481 A * 10/1991 Bartlett et al. ..... 62/51.2
5,388,415 A * 2/1995 Glinka et al. ..... 62/51.2
6,530,234 B1 * 3/2003 Dobak et al. ..... 62/52.1

FOREIGN PATENT DOCUMENTS

JP 09-229503 A 9/1997
JP 2001-108320 A 4/2001

* cited by examiner

*Primary Examiner*—William C. Doerrler
(74) *Attorney, Agent, or Firm*—Nixon Peabody LLP; Donald R. Studebaker

(57) ABSTRACT

The cryogenic refrigeration system of the present invention includes a JT refrigerator and a pre-cooling refrigerator. The JT refrigerator includes a JT valve, which is fully opened during a clog elimination operation, and a first switching valve, which is provided along a low pressure line of a JT circuit and is closed during the clog elimination operation. The cryogenic refrigeration system includes a PL pipe for collecting a helium gas from a helium tank into a buffer tank. The PL pipe includes a second switching valve and a third switching valve, which are opened during the clog elimination operation.

15 Claims, 9 Drawing Sheets

CRYOGENIC REFRIGERATION SYSTEM

FIELD OF THE INVENTION

The present invention relates to a cryogenic refrigeration system, and more particularly to a countermeasure against an impurity in the system.

BACKGROUND OF THE INVENTION

A cryogenic refrigeration system employing a combination of a JT refrigerator and a pre-cooling refrigerator is known in the prior art, as disclosed in, for example, Japanese Laid-Open Patent Publication No. 9-229503. A GM refrigerator, or the like, is used as the pre-cooling refrigerator.

The JT refrigerator is a refrigerator that generates coldness of a cryogenic level by subjecting a high pressure helium gas from a compressor to a Joule-Thomson expansion through a JT valve. On the other hand, the GM refrigerator is a refrigerator that generates a coldness by expanding a high pressure helium gas from a compressor through the reciprocating movement of a displacer. The GM refrigerator as a pre-cooling refrigerator pre-cools the helium gas in the JT refrigerator before the Joule-Thomson expansion by using the coldness.

Some cryogenic refrigeration systems including a JT refrigerator and a pre-cooling refrigerator are provided with a heat-collecting heat exchanger that exchanges heat between a high pressure helium and a low pressure helium in the systems. Such a cryogenic refrigeration system performs a heat collecting operation within the system, thereby improving the operating efficiency.

However, if water as an impurity exists in the helium as a refrigerant, the water is frozen in the heat-collecting heat exchanger or in a pipe there around, which may clog the passageway. In view of this, a system as follows has been proposed in the art (see Japanese Laid-Open Patent Publication No. 2001-108320), in which a circuit for eliminating the clog in the passageway is added.

FIG. 9 illustrates such a cryogenic refrigeration system (100), including a compressor unit (101) and a refrigerator unit (102). The compressor unit (101) includes a low pressure side compressor (103) and a high pressure side compressor (104). The refrigerator unit (102) includes a GM refrigerator (112) having a first heat station (113) and a second heat station (114), and a JT refrigerator (111) having a JT valve (116).

In the compressor unit (101), a discharge side pipe (105) is connected to the discharge side of the high pressure side compressor (104), and a suction side pipe (109) is connected to the suction side of the low pressure side compressor (103). Oil separators (106) and an adsorber (107) are provided along the discharge side pipe (105). The discharge side pipe (105) diverges into two high pressure pipes (108, 110). The first high pressure pipe (108) is connected to the JT refrigerator (111), and the second high pressure pipe (110) is connected to the GM refrigerator (112). A flow rate control valve (135), and a switching valve (134) for preventing a refrigerant at room temperature from flowing into the refrigerator unit (102) when the operation of the system is shut down, are provided along the first high pressure pipe (108). Note that a check valve (126) for preventing a refrigerant at room temperature from flowing into the refrigerator unit (102) when the operation of the system is shut down is provided also along the suction side pipe (109).

A JT circuit (115) in the refrigerator unit (102) includes a high pressure line (117) and a low pressure line (118), and the JT valve (116) is provided along the high pressure line (117). A first pre-cooling section (119) in the first heat station (113) and a second pre-cooling section (120) in the second heat station (114) are provided along the high pressure line (117). Moreover, first to third heat-collecting heat exchangers (121–123) for exchanging heat between the high pressure helium gas flowing along the high pressure line (117) and the low pressure helium gas flowing along the low pressure line (118) are provided in the JT circuit (115).

As clog elimination means for eliminating a clog when the passageway of the first heat exchanger (121) is clogged, the cryogenic refrigeration system (100) includes a supply pipe (124) for supplying the discharge gas from the compressors (103, 104) to the outlet side of the high pressure side passageway of the first heat exchanger (121), and a collection pipe (125) for collecting the discharge gas, which has flowed through the high pressure side passageway of the first heat exchanger (121), into the suction side pipe (109) of the compressors (103, 104). In order to prevent the refrigerant from flowing into the supply pipe (124) and the collection pipe (125) during a normal cooling operation, a switching valve (127) is provided along the supply pipe (124) and a switching valve (129) is provided along the collection pipe (125). Conversely, in order to allow an appropriate flow of the refrigerant through the supply pipe (124) and the collection pipe (125) during a clog elimination operation, a switching valve (128) is provided along the first high pressure pipe (108) and a switching valve (130) is provided along the suction side pipe (109). Note that an adsorber (131), and a switching valve (132) for preventing the backflow of water from the adsorber (131) during a cooling operation, may be provided along the collection pipe (125). Moreover, a flow rate control valve (133) may be provided along the collection pipe (125).

During a cooling operation, the switching valve (128) and the switching valve (130) are opened, while the switching valve (127) and the switching valve (129) are closed, whereby the high pressure helium gas discharged from the compressors (103, 104) is cooled through the first heat exchanger (121)→the first pre-cooling section (119)→the second heat exchanger (122)→the second pre-cooling section (120)→the third heat exchanger (123). Then, the high pressure helium gas expands through the JT valve (116) to be a liquid helium on a cryogenic level, and the liquid helium flows into a helium tank (136). A helium gas, which is generated through evaporation in the helium tank (136), flows into the suction side pipe (109) of the compressors (103, 104) through the low pressure line (118), and is compressed through the compressors (103, 104). Then, the circulation as described above is repeated.

During a clog elimination operation, the switching valve (128) and the switching valve (130) are closed, while the switching valve (127) and the switching valve (129) are opened, whereby the high pressure helium gas discharged from the compressors (103, 104) is supplied to the outlet side of the high pressure side passageway of the first heat exchanger (121) through the supply pipe (124), and flows backwards along the high pressure side passageway. Even if water is frozen in the first heat exchanger (121), the frozen ice is melted by the high pressure helium gas because a high pressure helium gas has a relatively high temperature. Then, the high pressure helium gas flows along the collection pipe (125) together with an impurity in the first heat exchanger (121), and flows into the suction side pipe (109) of the compressors (103, 104). As described above, a clog of the first heat exchanger (121) is eliminated, and an impurity is removed.

However, with the cryogenic refrigeration system (100), it is not possible to eliminate a clog occurring in a downstream side portion of the high pressure side passageway of the first heat exchanger (121), e.g., the second heat exchanger (122) or the third heat exchanger (123).

Moreover, the operation of the JT refrigerator (111) needs to be shut down temporarily during a clog elimination operation. Then, the liquid helium in the helium tank (136) is likely to evaporate, whereby the pressure inside the helium tank (136) increases. The conventional cryogenic refrigeration system (100) addresses the problem as follows. When the pressure inside the helium tank (136) increases excessively, a release valve (not shown) provided in the helium tank (136) is opened so as to release the helium gas into the atmosphere, thereby reducing the pressure. In this way, however, it is necessary to re-supply a significant amount of helium to the system after the completion of a clog elimination operation before a cooling operation can be resumed. This inevitably increases the running cost of the system.

The present invention has been made in view of these problems in the art, and has an object to provide a novel technique for a cryogenic refrigeration system, with which a clog can be eliminated over a wider area and which can contribute to a reduction in the running cost of the system.

SUMMARY OF THE INVENTION

A first cryogenic refrigeration system of the present invention includes: a compressor; a JT refrigerator including a JT valve through which a high pressure refrigerant gas discharged from the compressor is subjected to a Joule-Thomson expansion, and a refrigerant tank for storing the refrigerant, which has been liquefied by the Joule-Thomson expansion; a first heat exchanger, including a high pressure side passageway through which the high pressure refrigerant gas discharged from the compressor is passed and a low pressure side passageway through which a low pressure refrigerant gas from the refrigerant tank is passed, for exchanging heat between the high pressure refrigerant gas in the high pressure side passageway and the low pressure refrigerant gas in the low pressure side passageway; a pre-cooling refrigerator for pre-cooling the high pressure refrigerant gas, which has been cooled through the first heat exchanger, before the expansion through the JT valve; a first switching valve provided on an outlet side of the low pressure side passageway of the first heat exchanger; and a gas refrigerant collecting pipe including a second switching valve therealong and connecting the refrigerant tank with a pipe on a suction side of the compressor, wherein a clog elimination operation is performed, during which the JT valve is opened while the first switching valve is closed and the second switching valve is opened so that the refrigerant discharged from the compressor is passed at least through the high pressure side passageway of the first heat exchanger and the JT valve into the refrigerant tank while the refrigerant gas in the refrigerant tank is collected through the gas refrigerant collecting pipe.

A second cryogenic refrigeration system is similar to the first cryogenic refrigeration system, further including one or more heat exchanger, provided on a downstream side of the high pressure side passageway of the first heat exchanger, for exchanging heat between the high pressure refrigerant gas and the low pressure refrigerant gas.

A third cryogenic refrigeration system is similar to the first cryogenic refrigeration system, further including: a second heat exchanger and a third heat exchanger, provided on a downstream side of the high pressure side passageway of the first heat exchanger, for exchanging heat between the high pressure refrigerant gas and the low pressure refrigerant gas; a bypass pipe having one end thereof connected between the high pressure side passageway of the first heat exchanger and a high pressure side passageway of the second heat exchanger and the other end thereof connected between a high pressure side passageway of the third heat exchanger and the JT valve; and a switching valve provided along the bypass pipe, wherein during the clog elimination operation, the switching valve of the bypass pipe is opened so that the refrigerant discharged from the compressor is passed through the high pressure side passageway of the first heat exchanger, the bypass pipe and the JT valve into the refrigerant tank.

A fourth cryogenic refrigeration system is similar to the first cryogenic refrigeration system, further including: a second heat exchanger and a third heat exchanger, provided on a downstream side of the high pressure side passageway of the first heat exchanger, for exchanging heat between the high pressure refrigerant gas and the low pressure refrigerant gas; a bypass pipe having one end thereof connected between a high pressure side passageway of the second heat exchanger and a high pressure side passageway of the third heat exchanger and the other end thereof connected between, the high pressure side passageway of the third heat exchanger and the JT valve; and a switching valve provided along the bypass pipe, wherein during the clog elimination operation, the switching valve of the bypass pipe is opened so that the refrigerant discharged from the compressor is passed through the high pressure side passageway of the first heat exchanger, the high pressure side passageway of the second heat exchanger, the bypass pipe and the JT valve into the refrigerant tank.

A fifth cryogenic refrigeration system is similar to the first cryogenic refrigeration system, wherein an adsorber is provided along the gas refrigerant collecting pipe.

A sixth cryogenic refrigeration system is similar to the fifth cryogenic refrigeration system, further including a third switching valve provided between the adsorber of the gas refrigerant collecting pipe and the refrigerant tank, wherein the third switching valve is opened during the clog elimination operation and closed otherwise.

A seventh cryogenic refrigeration system is similar to the first cryogenic refrigeration system, wherein an adsorber is provided on an upstream side of the JT valve.

An eighth cryogenic refrigeration system includes: a compressor; a JT refrigerator including a JT valve through which a high pressure refrigerant gas discharged from the compressor is subjected to a Joule-Thomson expansion, and a refrigerant tank for storing the refrigerant, which has been liquefied by the Joule-Thomson expansion; a first heat exchanger, including a high pressure side passageway through which the high pressure refrigerant gas discharged from the compressor is passed and a low pressure side passageway through which a low pressure refrigerant gas from the refrigerant tank is passed, for exchanging heat between the high pressure refrigerant gas in the high pressure side passageway and the low pressure refrigerant gas in the low pressure side passageway; a pre-cooling refrigerator for pre-cooling the high pressure refrigerant gas, which has been cooled through the first heat exchanger, before the expansion through the JT valve; a first switching valve provided on an outlet side of the low pressure side passageway of the first heat exchanger; a gas refrigerant collecting pipe including a second switching valve therealong and connecting the refrigerant tank with a pipe on a suction side of the compressor; a second heat exchanger and a third heat exchanger, provided on a downstream side of the high pressure side passageway of the first heat exchanger, for exchanging heat between the high pressure refrigerant gas and the low pressure refrigerant gas; and a bypass pipe including a switching valve therealong and having one end thereof connected between the high pressure side passageway of the first heat exchanger and a high pressure side passageway of the second heat exchanger and the other end thereof connected between the JT valve and the refrigerant tank, wherein a clog elimination operation is performed, during which the JT valve is opened while the first switching valve is closed and the second switching valve and the switching valve of the bypass pipe are opened so that the refrigerant discharged from the compressor is passed through the high pressure side passageway of the first heat exchanger into the refrigerant tank while the refrigerant gas in the refrigerant tank is collected through the gas refrigerant collecting pipe.

A ninth cryogenic refrigeration system is similar to the eighth cryogenic refrigeration system, wherein an adsorber is provided along the gas refrigerant collecting pipe.

A tenth cryogenic refrigeration system is similar to the ninth cryogenic refrigeration system, further including a third switching valve provided between the adsorber of the gas refrigerant collecting pipe and the refrigerant tank, wherein the third switching valve is opened during the clog elimination operation and closed otherwise.

An eleventh cryogenic refrigeration system is similar to the eighth cryogenic refrigeration system, wherein an adsorber is provided on an upstream side of the JT valve.

A twelfth cryogenic refrigeration system includes: a compressor; a JT refrigerator including a JT valve through which a high pressure refrigerant gas discharged from the compressor is subjected to a Joule-Thomson expansion, and a refrigerant tank for storing the refrigerant, which has been liquefied by the Joule-Thomson expansion; a first heat exchanger, including a high pressure side passageway through which the high pressure refrigerant gas discharged from the compressor is passed and a low pressure side passageway through which a low pressure refrigerant gas from the refrigerant tank is passed, for exchanging heat between the high pressure refrigerant gas in the high pressure side passageway and the low pressure refrigerant gas in the low pressure side passageway; a pre-cooling refrigerator for pre-cooling the high pressure refrigerant gas, which has been cooled through the first heat exchanger, before the expansion through the JT valve; a first switching valve provided on an outlet side of the low pressure side passageway of the first heat exchanger; a gas refrigerant collecting pipe including a second switching valve therealong and connecting the refrigerant tank with a pipe on a suction side of the compressor; a second heat exchanger and a third heat exchanger, provided on a downstream side of the high pressure side passageway of the first heat exchanger, for exchanging heat between the high pressure refrigerant gas and the low pressure refrigerant gas; and a bypass pipe including a switching valve therealong and having one end thereof connected between a high pressure side passageway of the second heat exchanger and a high pressure side passageway of the third heat exchanger and the other end thereof connected between the JT valve and the refrigerant tank, wherein a clog elimination operation is performed, during which the JT valve is opened while the first switching valve is closed and the second switching valve and the switching valve of the bypass pipe are opened so that the refrigerant discharged from the compressor is passed through the high pressure side passageway of the first heat exchanger and the high pressure side passageway of the second heat exchanger into the refrigerant tank while the refrigerant gas in the refrigerant tank is collected through the gas refrigerant collecting pipe.

A thirteenth cryogenic refrigeration system is similar to the twelfth cryogenic refrigeration system, wherein an adsorber is provided along the gas refrigerant collecting pipe.

A fourteenth cryogenic refrigeration system is similar to the thirteenth cryogenic refrigeration system, further including a third switching valve provided between the adsorber of the gas refrigerant collecting pipe and the refrigerant tank, wherein the third switching valve is opened during the clog elimination operation and closed otherwise.

A fifteenth cryogenic refrigeration system is similar to the twelfth cryogenic refrigeration system, wherein an adsorber is provided on an upstream side of the JT valve.

With the first cryogenic refrigeration system, during the normal cooling operation, the high pressure refrigerant discharged from the compressor is cooled through the first heat exchanger, further cooled through the pre-cooling refrigerator, liquefied by the Joule-Thomson expansion through the JT valve, and then passed into the refrigerant tank. On the other hand, during the clog elimination operation, the high pressure refrigerant discharged from the compressor is passed through the high pressure side passageway of the first heat exchanger and the JT valve into the refrigerant tank. In this way, not only an impurity staying in the high pressure side passageway of the first heat exchanger, but also an impurity staying on the downstream side of the high pressure side passageway, is removed by the high pressure refrigerant. At least a portion of the gas refrigerant in the refrigerant tank is guided to the pipe on the suction side of the compressor through the gas refrigerant collecting pipe without being released into the atmosphere. Therefore, at least a portion of the gas refrigerant is not released into the atmosphere but is re-used for the cooling operation, thereby reducing the running cost of the system.

With the second cryogenic refrigeration system, a plurality of heat exchangers are provided and connected in series with one another, whereby not only a clog in the first heat exchanger, which is located at the most upstream position, but also a clog in another heat exchanger on the downstream side of the first heat exchanger, is eliminated.

With the third and eighth cryogenic refrigeration systems, it is possible to perform clog elimination exclusively for the first heat exchanger.

With the fourth and twelfth cryogenic refrigeration systems, it is possible to perform clog elimination exclusively for the first heat exchanger and the second heat exchanger.

With the fifth, ninth and thirteenth cryogenic refrigeration systems, the adsorber is provided along the gas refrigerant collecting pipe, whereby an impurity having flowed into the refrigerant tank is removed by the adsorber while the gas refrigerant in the refrigerant tank is collected through the gas refrigerant collecting pipe.

With the sixth, tenth and fourteenth cryogenic refrigeration systems, during the cooling operation, the third switching valve is closed, whereby the upstream side of the adsorber of the gas refrigerant collecting pipe is sealed, thus preventing the impurity having been adsorbed during the clog elimination operation from flowing back into the refrigerant tank during the cooling operation.

With the seventh, eleventh and fifteenth cryogenic refrigeration systems, the adsorber is provided on the upstream side of the JT valve, whereby an impurity staying on the downstream side of a high pressure side passageway of a heat exchanger is adsorbed and removed by the adsorber.

With the present invention, during the clog elimination operation, the high pressure refrigerant discharged from the compressor is supplied to the high pressure side passageway of the first heat exchanger and further to the downstream side of the high pressure side passageway, whereby not only a clog in the first heat exchanger, but also a clog in a passageway downstream of the first heat exchanger, can be eliminated. The gas refrigerant in the refrigerant tank is collected through the gas refrigerant collecting pipe during the clog elimination operation, whereby it is possible to suppress an increase in the pressure inside the refrigerant tank. Moreover, the collected refrigerant can be re-used for the cooling operation, whereby it is possible to reduce the running cost.

DESCRIPTION OF THE PREFERRED EMBODIMENTS

Embodiments of the present invention will now be described with reference to the drawings.

EMBODIMENT 1

A cryogenic refrigeration system of the present embodiment is a cryogenic refrigeration system that is installed in a superconducting linear motor car (not shown) for cooling a superconducting coil (not shown) to a cryogenic level.

Configuration of Cryogenic Refrigeration System

Figure 1:
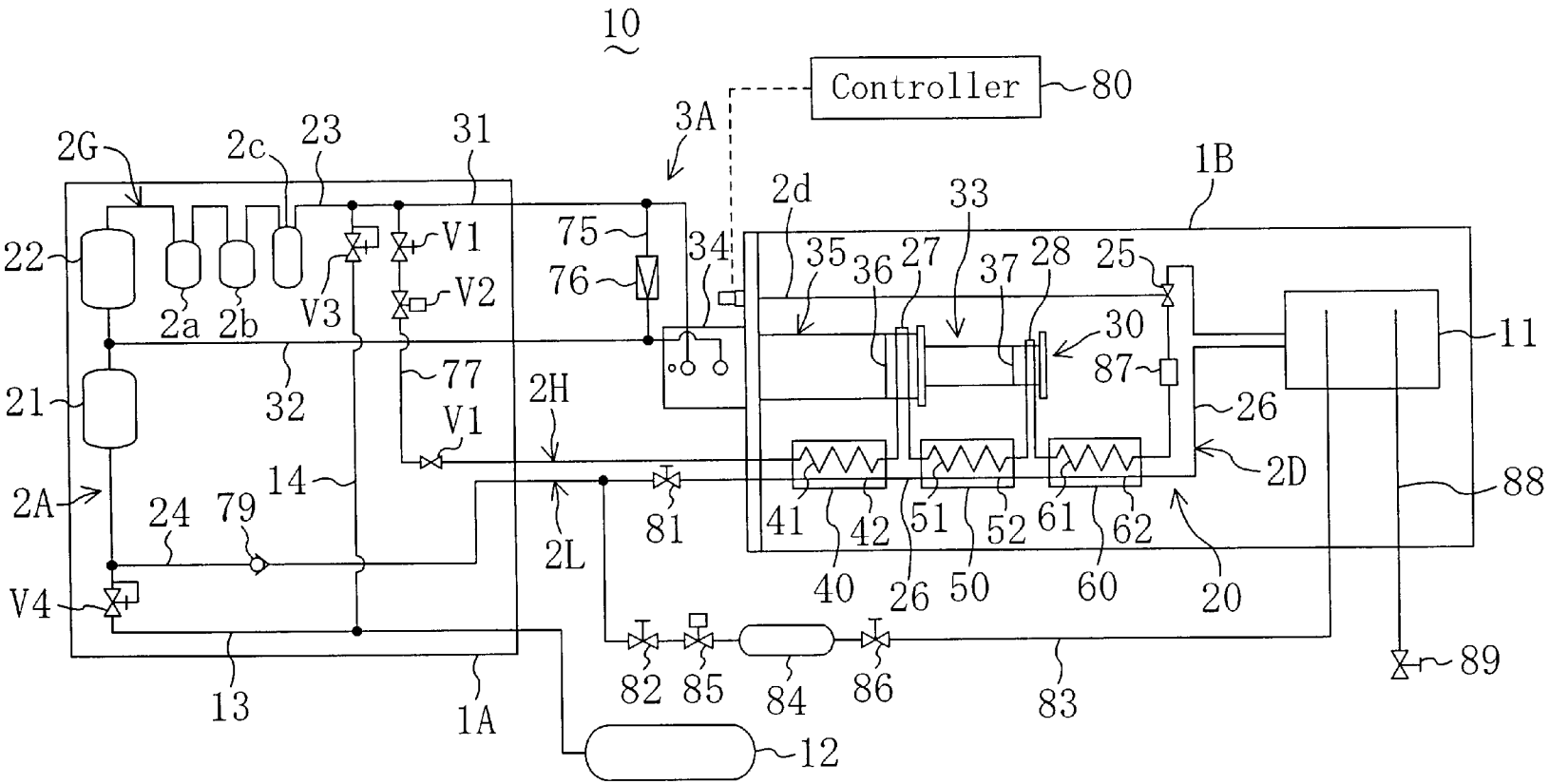
FIG. 1 is a refrigerant circuit diagram of a cryogenic refrigeration system according to Embodiment 1.

As illustrated in FIG. 1, a cryogenic refrigeration system (10) includes a helium tank (11) for storing liquid helium, and the superconducting coil is cooled to a temperature that is less than or equal to the critical temperature by using the liquid helium in the helium tank (11).

The cryogenic refrigeration system (10) includes a JT refrigerator (20) and a pre-cooling refrigerator (30). A JT circuit (2A), which is a refrigerant circuit of the JT refrigerator (20), and a pre-cooling circuit (3A), which is a refrigerant circuit of the pre-cooling refrigerator (30), are provided across a compressor unit (1A) and a refrigerator unit (1B). The JT circuit (2A) includes a low temperature section (2D) provided in the refrigerator unit (1B), and a room temperature section (2G) provided in the compressor unit (1A).

The compressor unit (1A) functions both as a compressor unit for the JT circuit (2A) and as a compressor unit for the pre-cooling circuit (3A). The compressor unit (1A) includes a low pressure side compressor (21) and a high pressure side compressor (22) for providing a two-stage compression of a helium gas.

A high pressure pipe (23) is connected to the discharge side of the high pressure side compressor (22). A low pressure pipe (24) is connected to the suction side of the low pressure side compressor (21). Two oil separators (2*a*, 2*b*) and an adsorber (2*c*) are provided in this order along the high pressure pipe (23) from the discharge side of the high pressure side compressor (22). The high pressure pipe (23) diverges into a high pressure pipe (77) for the JT circuit (2A) and a high pressure pipe (31) for the pre-cooling circuit (3A). A switching valve (V1) and a flow rate control valve (V2) are provided in this order along the high pressure pipe (77) of the JT circuit (2A) from the discharge side of the high pressure side compressor (22). A check valve (79) for allowing the refrigerant only to flow toward the low pressure side compressor (21) and a first switching valve (81) are provided in this order along the low pressure pipe (24) from the compressor unit (1A) side toward the refrigerator unit (1B) side. Note that the check valve (79) is a valve that is provided for the purpose of preventing a helium gas at room temperature from flowing from the room temperature section (2G) toward the low temperature section (2D) of the JT circuit (2A) while the compressors (21, 22) are shut down.

A medium pressure pipe (32) of the pre-cooling circuit (3A) is connected between the discharge side of the low pressure side compressor (21) and the suction side of the high pressure side compressor (22). With such a configuration, the high pressure side compressor (22) functions both as a compressor for the JT circuit (2A) and as a compressor for the pre-cooling circuit (3A).

A buffer tank (12) is connected to the suction side of the low pressure side compressor (21) via a gas pipe (13). A low pressure control valve (V4) is provided along the gas pipe (13). The low pressure control valve (V4) is designed so that it is automatically opened when the pressure of the low pressure pipe (24) (i.e., the pressure on the low pressure side) decreases below a predetermined value. As the low pressure control valve (V4) is opened, the helium gas in the buffer tank (12) is re-supplied to the JT circuit (2A).

An excessive gas collecting pipe (14) diverging from the high pressure pipe (23) is connected to the gas pipe (13). Specifically, one end of the excessive gas collecting pipe (14) is connected to the high pressure pipe (23) between the adsorber (2*c*) and a diverging point (where the high pressure pipe (23) diverges into the high pressure pipes (31, 77)), and the other end thereof is connected to the gas pipe (13). A high pressure control valve (V3) is provided along the excessive gas collecting pipe (14). The high pressure control valve (V3) is designed so that it is automatically opened when the pressure of the high pressure pipe (23) (i.e., the pressure on the high pressure side) increases above a predetermined value. As the high pressure control valve (V3) is opened, the high pressure helium gas is collected into the buffer tank (12).

Next, the refrigerator unit (1B) will be described. The refrigerator unit (1B) includes the pre-cooling refrigerator (30) and the low temperature section (2D) of the JT circuit (2A).

The pre-cooling refrigerator (30) is provided for the purpose of pre-cooling the helium gas, which is the refrigerant of the JT refrigerator (20), and is a gas pressure driven G-M (Gifford-McMahon) cycle refrigerator, in which a displacer is reciprocated by the pressure of a helium gas. The pre-cooling refrigerator (30) includes a motor head (34) and a two-stage cylinder (35) coupled to the motor head (34). The high pressure pipe (31) and the medium pressure pipe (32) are connected to the motor head (34). A first heat station (36), which is cooled and maintained at a predetermined temperature level, is provided on the distal side of the large-diameter portion of the cylinder (35). Moreover, a second heat station (37), which is cooled and maintained at a temperature level that is lower than the first heat station (36), is provided on the distal side of the small-diameter portion of the cylinder (35).

Although not shown, two free-type displacers are reciprocably housed in the cylinder (35). Partitioned expansion spaces are defined by the displacers at positions corresponding to the heat stations (36, 37), respectively.

A rotary valve and a valve motor for driving the rotary valve are housed in the motor head (34). The rotary valve is designed so that it is alternately switched between a supply position, at which a high pressure helium gas in the high pressure pipe (31) is supplied to the expansion spaces of the cylinder (35), and a discharge position, at which a low pressure helium gas having been expanded in the expansion spaces is discharged to the medium pressure pipe (32).

Moreover, the motor head (34) includes a medium pressure chamber that is communicated to an expansion space of the cylinder (35) via an orifice. As the rotary valve is switched, a pressure difference is generated between the medium pressure chamber and the expansion space, and the displacer reciprocates with the pressure difference being the driving force. The high pressure helium gas undergoes a Simon expansion in each expansion space of the cylinder (35) as the rotary valve is opened/closed. Coldness of a cryogenic level is generated by the helium gas expansion. The coldness is kept in the first and second heat stations (36, 37) and is used for pre-cooling the high pressure helium gas in the JT refrigerator (20).

The JT circuit (2A) is a circuit that generates coldness of about 4 K level through a Joule-Thomson expansion of a helium gas. The low temperature section (2D) of the JT circuit (2A) includes a first heat exchanger (40), a second heat exchanger (50), a third heat exchanger (60), a JT valve (25) and the helium tank (11). Each of the heat exchangers (40, 50, 60) exchanges heat between a high pressure helium gas and an expanded, low pressure helium gas. The first heat exchanger (40), the second heat exchanger (50) and the third heat exchanger (60) have successively decreasing heat exchange temperatures.

The inlet side of a high pressure side passageway (41) of the first heat exchanger (40) is connected to the high pressure pipe (77). A first pre-cooling section (27) is provided between the outlet side pipe of the high pressure side passageway (41) of the first heat exchanger (40) and the inlet side of a high pressure side passageway (51) of the second heat exchanger (50). The first pre-cooling section (27) is provided around the periphery of the first heat station (36) of the pre-cooling refrigerator (30). A second pre-cooling section (28) is provided between the outlet side of the high pressure side passageway (51) of the second heat exchanger (50) and the inlet side of a high pressure side passageway (61) of the third heat exchanger (60). The second pre-cooling section (28) is provided around the periphery of the second heat station (37) of the pre-cooling refrigerator (30). The JT valve (25) is provided between the outlet side of the high pressure side passageway (61) of the third heat exchanger (60) and the helium tank (11). Moreover, an adsorber (87) is provided between the high pressure side passageway (61) of the third heat exchanger (60) and the JT valve (25).

An operation rod (2*d*) for adjusting the valve opening is coupled to the JT valve (25). The JT valve (25) is designed so that the opening thereof is controlled by a controller (80), and it is filly opened during a clog elimination operation to be described later.

Thus, a high pressure line (2H), along which a high pressure helium gas passes, extends from the high pressure side compressor (22) to the high pressure pipe (23), the high pressure pipe (77), the high pressure side passageways (41, 51, 61) of the heat exchangers (40, 50, 60), the pre-cooling sections (27, 28) and the JT valve (25).

A low pressure side passageway (62) of the third heat exchanger (60), a low pressure side passageway (52) of the second heat exchanger (50) and a low pressure side passageway (42) of the first heat exchanger (40) are connected in series by a refrigerant pipe (26). The low pressure side passageway (62) of the third heat exchanger (60) is connected to the helium tank (11) via the refrigerant pipe (26). The low pressure side passageway (42) of the first heat exchanger (40) is connected to the low pressure pipe (24). Thus, a low pressure line (2L), along which a low pressure helium gas passes, extends from the helium tank (11) to the low pressure side compressor (21) via the low pressure side passageways (62, 52, 42) of the heat exchangers (60, 50, 40).

The helium tank (11) and the low pressure pipe (24) are connected to each other by a PL pipe (83). One end of the PL pipe (83) is connected to the helium tank (11), and the other end thereof is connected to the low pressure pipe (24) between the first switching valve (81) and the check valve (79). A third switching valve (86), an adsorber (84), a flow rate control valve (85) and a second switching valve (82) are provided along the PL pipe (83) in this order from one end closer to the helium tank (11) to the other end. Note that each of the first switching valve (81), the second switching valve (82) and the PL pipe (83) is an electromagnetic valve. The second switching valve (82) and the third switching valve (86) are designed to operate in synchronism with each other.

Moreover, a discharge pipe (88) is connected to the helium tank (11) for discharging the helium gas from the helium tank (11) into the atmosphere. A switching valve (89), which is an electromagnetic valve, is provided along the discharge pipe (88), and the switching valve (89) is designed so that it is automatically opened when the pressure inside the helium tank (11) increases excessively.

The first heat exchanger (40), the second heat exchanger (50) and the third heat exchanger (60) are structurally similar to one another. The structure of only the first heat exchanger (40) will now be described with reference to FIG. 2, while those of the second heat exchanger (50) and the third heat exchanger (60) will not be described.

Figure 2:
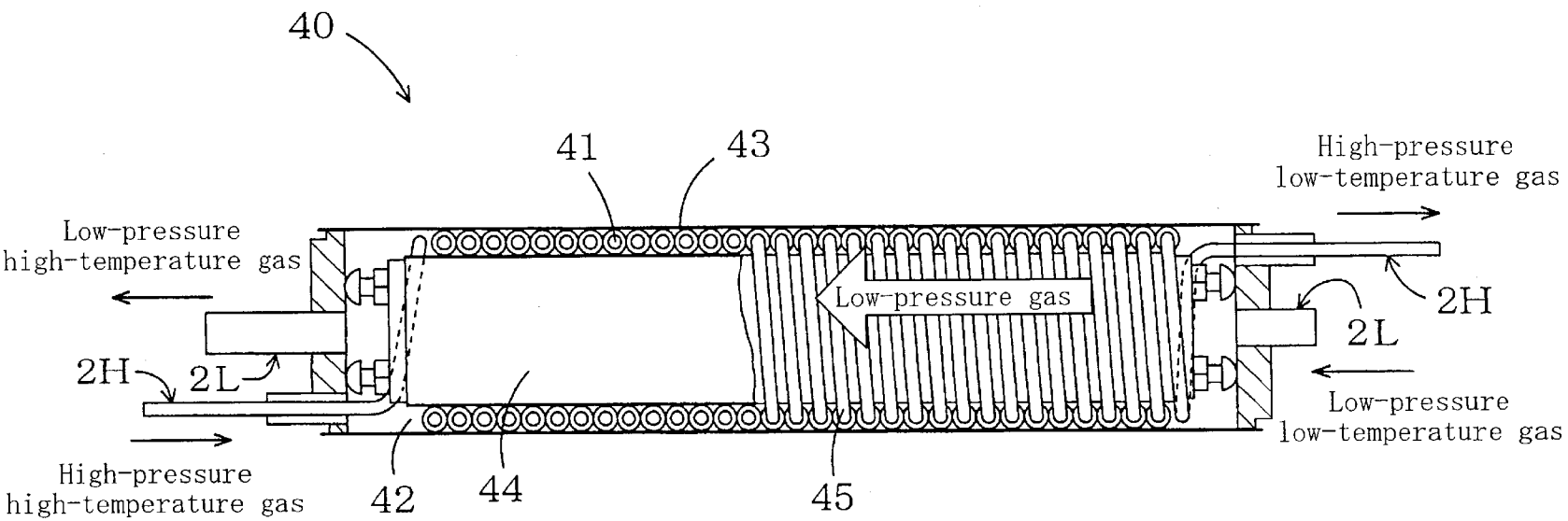
FIG. 2 is a longitudinal sectional view illustrating a first heat exchanger.

As illustrated in FIG. 2, the first heat exchanger (40) includes a tube (43), a mandrel (44) housed in the tube (43), and a high pressure pipe (45). The high pressure pipe (45) is a finned heat transfer pipe that is spirally wound around the mandrel (44). The inside of the high pressure pipe (45) serves as the high pressure side passageway (41), along which a high pressure helium gas flows . On the other hand, the space between the tube (43) and the mandrel (44) serves as the low pressure side passageway (42), along which a low pressure helium gas flows. Thus, heat is exchanged between the high pressure helium gas in the high pressure side passageway (41) and the low pressure helium gas in the low pressure side passageway (42) via the high pressure pipe (45).

Note that a bypass pipe (75) is provided between the high pressure pipe (31) and the medium pressure pipe (32) of the pre-cooling refrigerator (30), as illustrated in FIG. 1. A differential pressure valve (76) is provided along the bypass pipe (75). When the valve motor of the pre-cooling refrigerator (30) is stopped for a clog elimination operation, a high pressure helium gas is bypassed to the medium pressure pipe (32) by the action of the differential pressure valve (76).

In some cases, a cryogenic refrigeration system may be contaminated with impurities, including an impurity gas (i.e., a gas other than helium) such as the air, and water. Particularly, since the cryogenic refrigeration system of the present embodiment employs a configuration in which the liquid helium for cooling the superconducting coil and the helium gas as a refrigerant flow in an open circuit (i.e., an open cycle configuration), thus requiring the injection of liquid helium and the re-supply of a helium gas, it has a higher possibility of contamination with impurities as compared with other closed cycle systems. If water enters the system as an impurity, the water is cooled and frozen, and it may then clog a passageway. In view of this, the cryogenic refrigeration system (10) is capable of performing a clog elimination operation for eliminating a clog in a passageway, in addition to a cooling operation for cooling a superconducting coil.

Next, these operations will be described.

Cooling Operation

The cooling operation is an operation for cooling and maintaining a superconducting coil to a temperature that is less than or equal to the critical temperature by using the liquid helium in the helium tank (11). In this operation, a helium gas that is generated through evaporation while cooling the superconducting coil flows out of the helium tank (11) and then through the low pressure line (2L) of the JT circuit (2A). Then, the helium gas is compressed through the compressors (21, 22) and expanded through the JT valve (25), whereby the helium gas is liquefied again. Then, the liquefied helium returns to the helium tank (11). Through such a circulation, a predetermined amount of liquid helium is always stored in the helium tank (11), and thus the superconducting coil is cooled stably.

Figure 3:
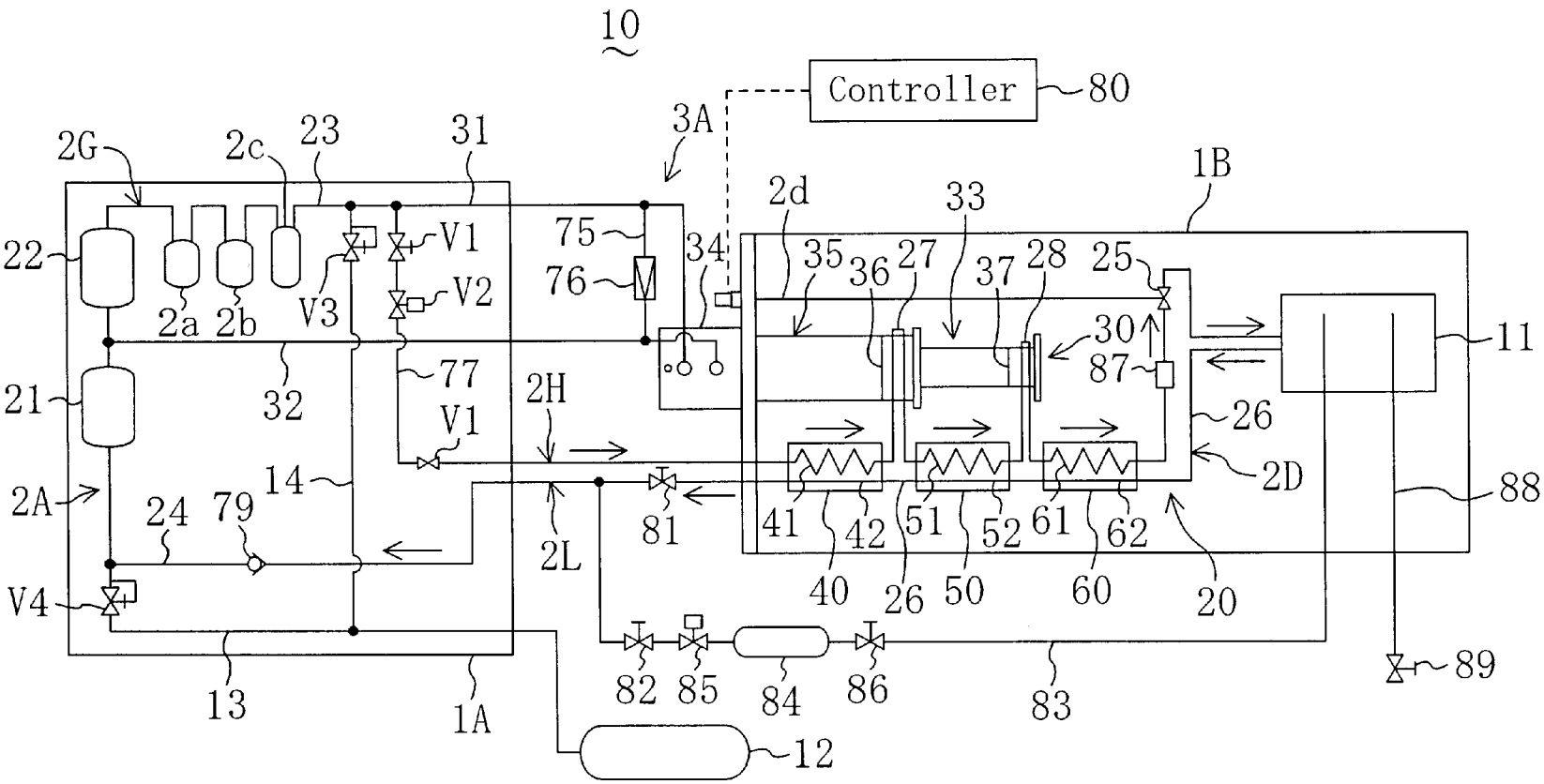
FIG. 3 is a refrigerant circuit diagram illustrating the circulation of a refrigerant during a cooling operation.

In the cooling operation, helium in the JT circuit (2A) and the pre-cooling circuit (3A) circulates as shown by a solid-line arrow in FIG. 3. Specifically, in the cooling operation, the first switching valve (81) along the low pressure line (2L) of the JT circuit (2A) is opened, and the second switching valve (82) and the third switching valve (86) along the PL pipe (83) are closed. The JT valve (25) is adjusted to a predetermined opening, and the valve motor of the pre-cooling refrigerator (30) is turned ON.

In this state, a portion of the high pressure helium gas discharged from the high pressure side compressor (22) flows into the pre-cooling refrigerator (30) through the high pressure pipe (31). The high pressure helium gas is expanded in the expansion spaces in the cylinder (35) of the pre-cooling refrigerator (30). The temperature of the helium gas decreases through the expansion, and the heat stations (36, 37) are each cooled to a predetermined temperature level. The expanded helium gas returns to the high pressure side compressor (22) through the medium pressure pipe (32). In the pre-cooling circuit (3A), the refrigerant circulates as described above.

On the other hand, in the JT circuit (2A), the helium gas circulates as follows. Specifically, the remaining portion of the high pressure helium gas discharged from the high pressure side compressor (22) flows into the low temperature section (2D) of the JT circuit (2A) through the high pressure pipe (77). The high pressure helium gas, which has flowed into the low temperature section (2D), first passes through the high pressure side passageway (41) of the first heat exchanger (40). At this time, the high pressure helium gas passing through the high pressure side passageway (41) is cooled while it exchanges heat with the low pressure helium gas passing through the low pressure side passageway (42). For example, the high pressure helium gas is cooled in the first heat exchanger (40) from 300 K, which is a room temperature, to about 50 K. Then, the high pressure helium gas flows through the first pre-cooling section (27), and is cooled by the first heat station (36) of the pre-cooling refrigerator (30).

Then, the high pressure helium gas passes through the high pressure side passageway (51) of the second heat exchanger (50), and is cooled while it exchanges heat with the low pressure helium gas passing through the low pressure side passageway (52). For example, the high pressure helium gas is cooled to about 15 K while it passes through the high pressure side passageway (51) of the second heat exchanger (50). Then, the high pressure helium gas passes through the second pre-cooling section (28), and is cooled by the second heat station (37) of the pre-cooling refrigerator (30).

Then, the high pressure helium gas passes through the high pressure side passageway (61) of the third heat exchanger (60). At this time, the high pressure helium gas is cooled while it exchanges heat with the low pressure helium gas passing through the low pressure side passageway (62).

Then, the high pressure helium gas is turned into liquid helium at about 4 K by a Joule-Thomson expansion through the JT valve (25). Then, the liquid helium flows into the helium tank (11).

On the other hand, a low pressure helium gas that is generated through evaporation in the helium tank (11) flows from the low pressure side passageway (62) of the third heat exchanger (60) to the low pressure side passageway (52) of the second heat exchanger (50), and then to the low pressure side passageway (42) of the first heat exchanger (40), and returns to the low pressure side compressor (21) via the low pressure pipe (24).

If the high pressure side passageways (41, 51, 61) of the heat exchanger (40, 50,. 60) or the passageway of a pipe therearound is clogged with an impurity (e.g., water) during the cooling operation, a clog elimination operation as follows is performed. Note that the presence/absence of a clog in a passageway can be determined based on, for example, the loss in the pressure of the helium gas in the passageway. Alternatively, the clog elimination operation may be performed each time the cooling operation is performed for a predetermined amount of time, irrespective of the presence/absence of a clog. Now, the clog elimination operation will be described with reference to FIG. 4.

Clog Elimination Operation

Figure 4:
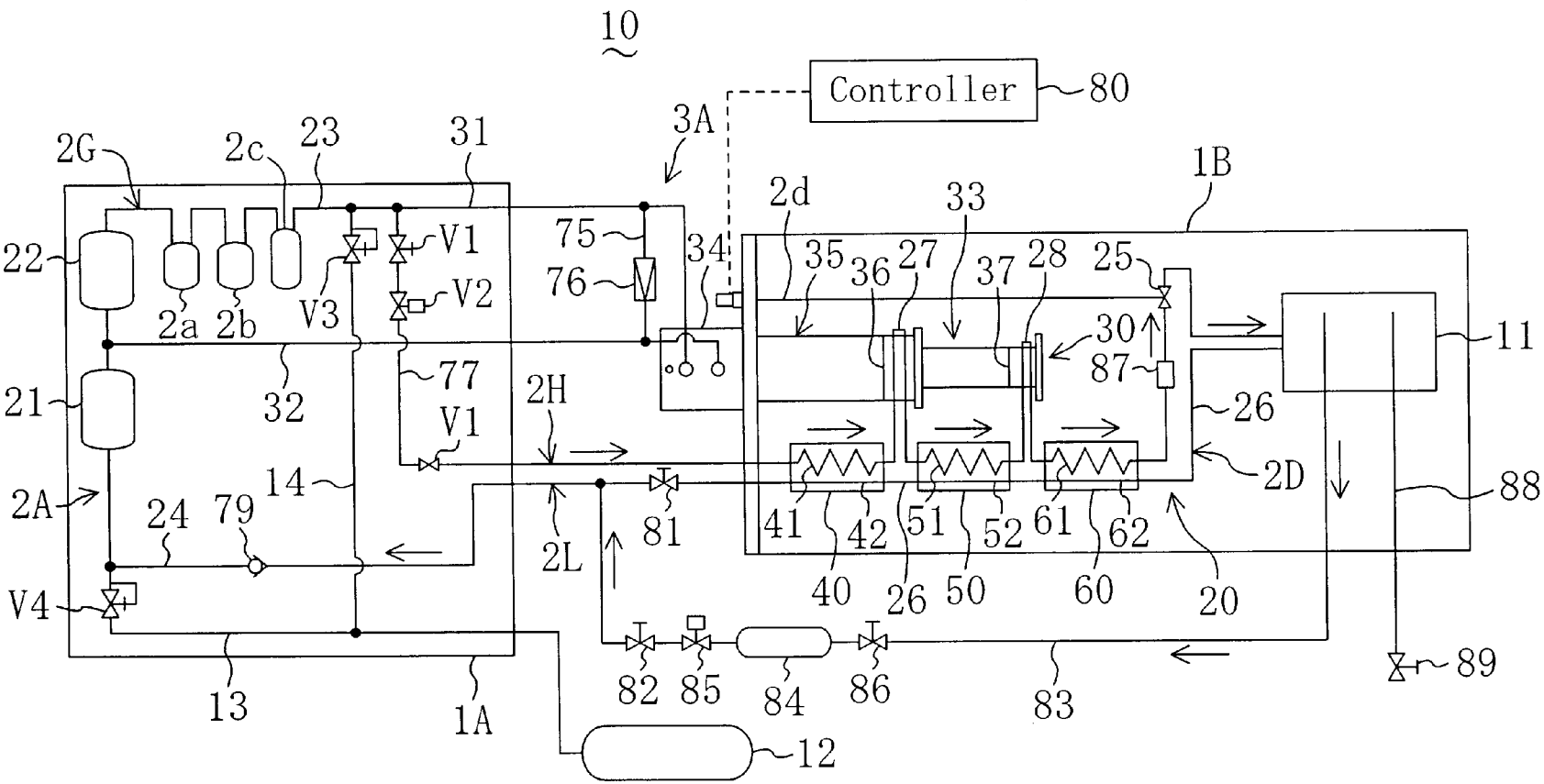
FIG. 4 is a refrigerant circuit diagram illustrating the circulation of a refrigerant during a clog elimination operation.

In the clog elimination operation, the helium gas circulates as shown by a solid-line arrow in FIG. 4. The first switching valve (81) along the low pressure line (2L) of the JT circuit (2A) is closed, and the second switching valve (82) and the third switching valve (86) along the PL pipe (83) are opened. The JT valve (25) is fully opened. The pre-cooling refrigerator (30) is turned OFF.

In this state, a portion of the high pressure helium gas discharged from the high pressure side compressor (22) flows along the high pressure line (2H) from the high pressure side passageway (41) of the first heat exchanger (40) to the first pre-cooling section (27), the high pressure side passageway (51) of the second heat exchanger (50), the second pre-cooling section (28), the high pressure side passageway (61) of the third heat exchanger (60) and then to the JT valve (25). Since the first switching valve (81) along the low pressure line (2L) is closed, the helium gas does not pass through the low pressure line (2L). Therefore, the high pressure helium gas is not cooled through the heat exchangers (40, 50, 60) or the pre-cooling sections (27, 28), but passes through the high pressure line (2H) with the temperature thereof remaining at a room temperature level. As a result, even if water is frozen in the passageway of the high pressure line (2H), the frozen water is melted by the high pressure helium gas and thus flows along the high pressure line (2H) toward the helium tank (11) together with the high pressure helium gas.

Since the adsorber (87) is provided along the high pressure line (2H), an impurity such as water contained in the high pressure helium is removed by the adsorber (87).

Since a helium gas at a room temperature flows into the helium tank (11), the temperature inside the helium tank (11) increases. As a result, the liquid helium in the helium tank (11) evaporates into a helium gas. The helium gas is passed into the low pressure pipe (24) through the PL pipe (83). At this time, an impurity contained in the helium gas is adsorbed and removed by the adsorber (84). The helium gas, which has been passed into the low pressure pipe (24), is compressed through the compressors (21, 22) and is collected into the buffer tank (12). If there is an excess amount of helium gas that cannot be collected, the excess helium gas may be released into the atmosphere via the discharge pipe (88), or it may be collected into another separately-provided buffer tank.

As described above, the clog in the passageway of the JT circuit (2A) is eliminated, and the impurity is removed. After the completion of the clog elimination operation, helium in the buffer tank (12) is brought back into the JT circuit (2A) and the cooling operation is resumed.

Effects of Embodiment

Thus, according to the present embodiment, it is possible to eliminate not only a clog in the high pressure side passageway (41) of the first heat exchanger (40), but also a clog in a passageway downstream of the high pressure side passageway (41). Moreover, during the clog elimination operation, at least a portion of the helium gas in the helium tank (11) is collected into the buffer tank (12) through the PL pipe (83), whereby it is no longer necessary to re-supply helium, or the amount of helium that needs to be re-supplied can be reduced, when resuming the cooling operation. Thus, the running cost can be reduced.

Note that a large amount of helium may evaporate in the helium tank (11) when an electric current is conducted through the superconducting coil, and it is often the case that the PL pipe (83) is provided in advance for collecting such an evaporated helium gas. In such a case, the existing PL pipe (83) may be used as it is, thereby eliminating the need to separately provide a dedicated pipe for collecting the helium gas from the helium tank (11) during the clog elimination operation. Therefore, it is possible to reduce the number of components that are additionally provided for the clog elimination operation.

The third switching valve (86), which is closed during the cooling operation, is provided on the upstream side of the adsorber (84) along the PL pipe (83), whereby it is possible to prevent an impurity that has been adsorbed during the clog elimination operation from flowing backwards from the adsorber (84) into the helium tank (11) during the cooling operation.

Variation

Note that while the first switching valve (81), the second switching valve (82) and the third switching valve (86) are controlled automatically by the controller (80) in the embodiment described above, these valves may of course be controlled manually.

Note that in a case where the impurity removal along the PL pipe (83) is not necessary, the adsorber (84) and the third switching valve (86) along the PL pipe (83) may be omitted.

EMBODIMENT 2

In Embodiment 2, Embodiment 1 is modified so that it is possible to perform clog elimination exclusively for the first heat exchanger (40).

Figure 5:
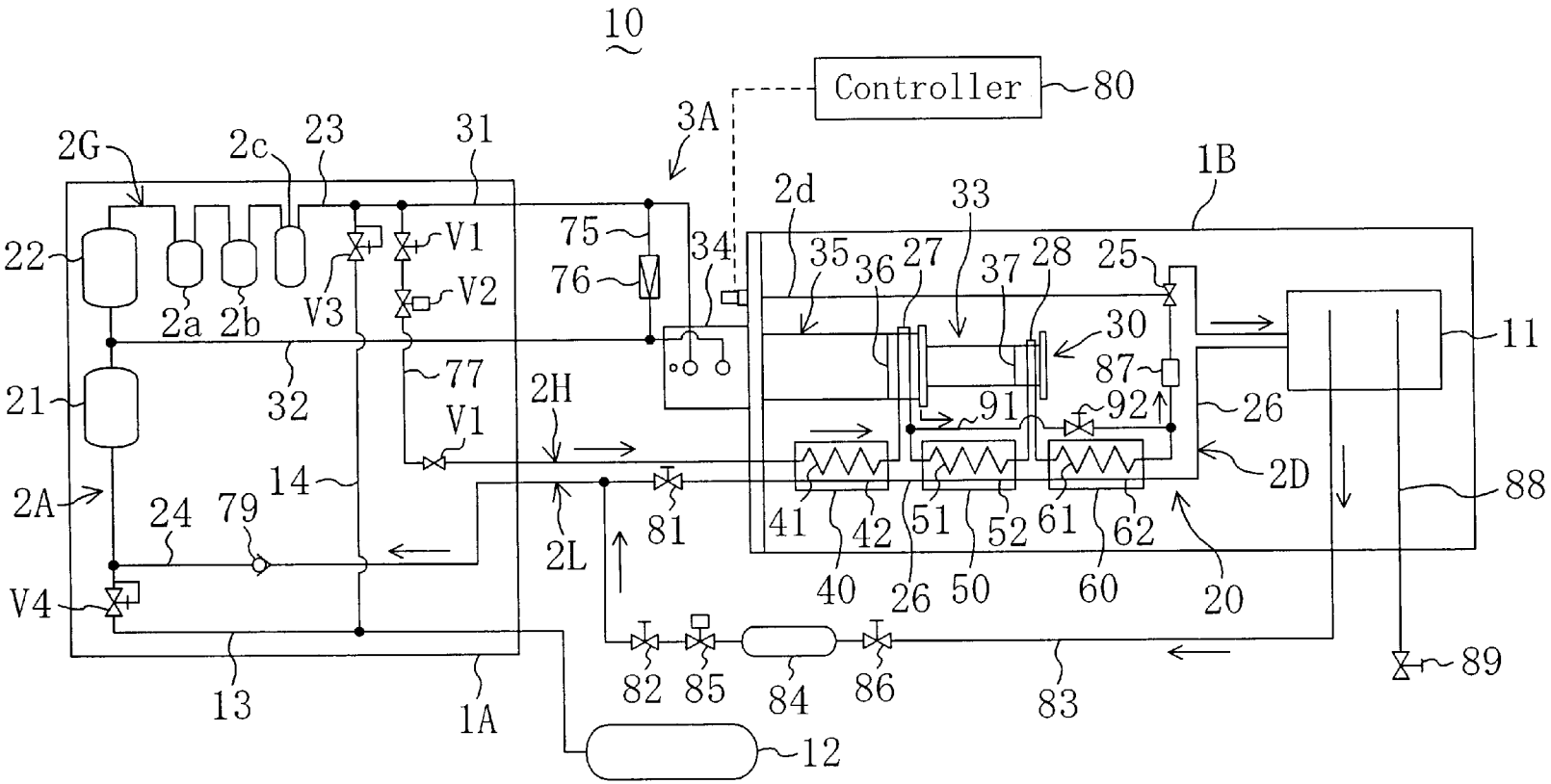
FIG. 5 is a refrigerant circuit diagram of a cryogenic refrigeration system according to Embodiment 2.

As illustrated in FIG. 5, the cryogenic refrigeration system (10) of Embodiment, 2 includes a bypass pipe (91). One end of the bypass pipe (91) is connected between the first pre-cooling section (27) of the pre-cooling refrigerator (30) and the high pressure side passageway (51) of the second heat exchanger (50), and the other end thereof is connected between the high pressure side passageway (61) of the third heat exchanger (60) and the adsorber (87). A switching valve (92), which is closed during the cooling operation, is provided along the bypass pipe (91).

In the present embodiment, a clog elimination operation as follows can be performed, in addition to the clog elimination operation of Embodiment 1. Specifically, in the present clog elimination operation, the first switching valve (81) along the low pressure line (2L) of the JT circuit (2A) is closed, and the second switching valve (82) and the third switching valve (86) along the PL pipe (83) are opened. The JT valve (25) is fully opened, and the pre-cooling refrigerator (30) is turned OFF. The switching valve (92) along the bypass pipe (91) is opened.

The helium gas circulates as shown by a solid-line arrow in FIG. 5. Specifically, a portion of the high pressure helium gas discharged from the high pressure side compressor (22) flows along the high pressure line (2H) from the high pressure side passageway (41) of the first heat exchanger (40) to the first pre-cooling section (27), the bypass pipe (91) and then to the JT valve (25), after which the helium gas flows into the helium tank (11). Thereafter, a helium gas is passed into the low pressure pipe (24) from the helium tank (11) through the PL pipe (83), as in the clog elimination operation of Embodiment 1.

Thus, according to the present embodiment, it is possible to perform clog elimination exclusively for the first heat exchanger (40), whereby in a case where only the first heat exchanger (40) is clogged, the clog can be eliminated effectively. Moreover, such an operation does not cause a temperature increase in the second heat exchanger (50) or the third heat exchanger (60), whereby it is possible to quickly resume the cooling operation after completion of the clog elimination operation.

Figure 6:
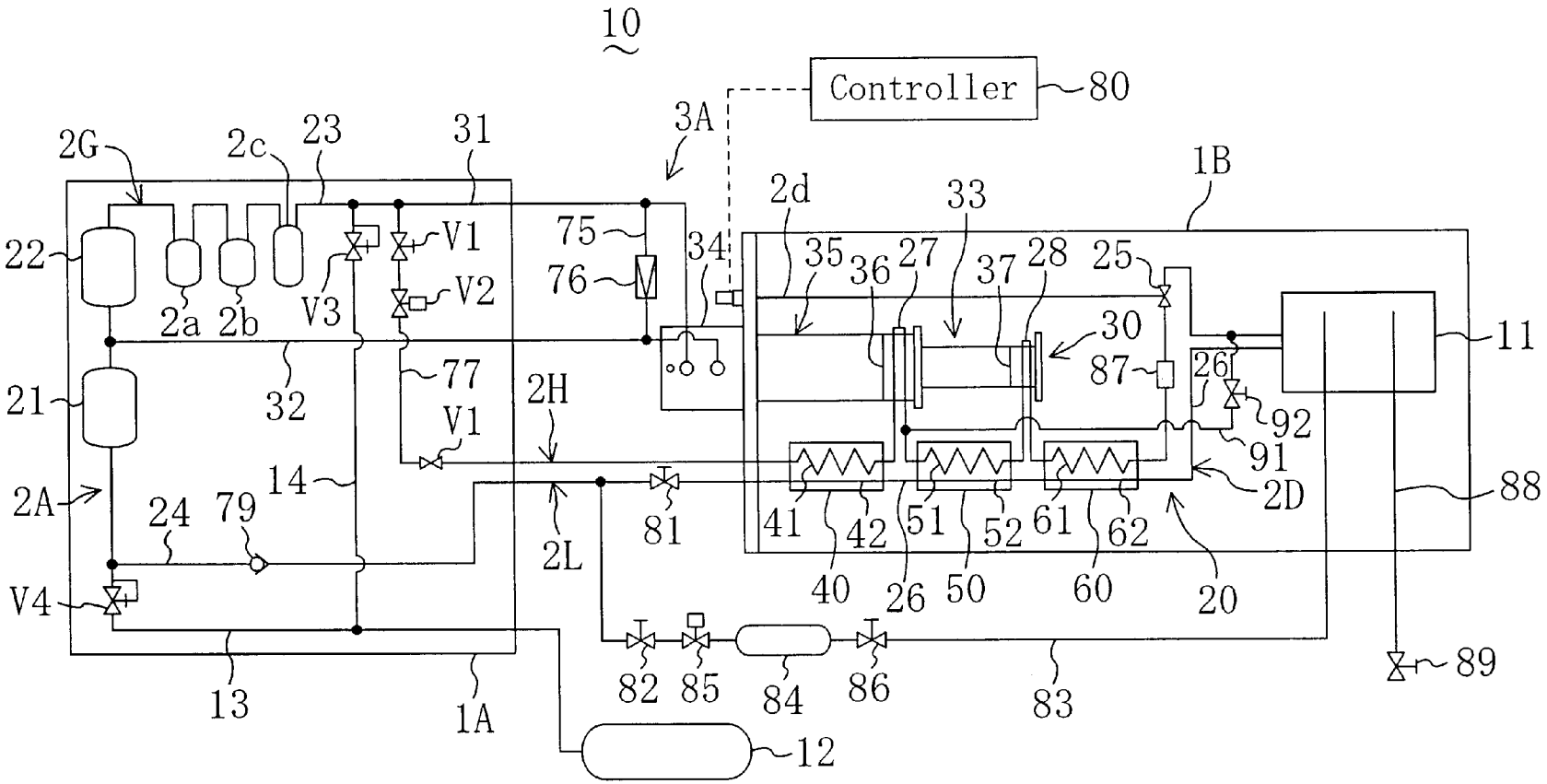
FIG. 6 is a refrigerant circuit diagram of a cryogenic refrigeration system according to a variation of Embodiment 2.

Note that the upstream end of the bypass pipe (91) may alternatively be connected between the high pressure side passageway (41) of the first heat exchanger (40) and the first pre-cooling section (27). Moreover, the downstream end of the bypass pipe (91) may alternatively be connected between the JT valve (25) and the helium tank (11), as illustrated in FIG. 6. Also with such alternative arrangements, the clog elimination operation as described above can be performed.

EMBODIMENT 3

In Embodiment 3, Embodiment 1 is modified so that it is possible to perform clog elimination exclusively for the first heat exchanger (40) and the second heat exchanger (50).

Figure 7:
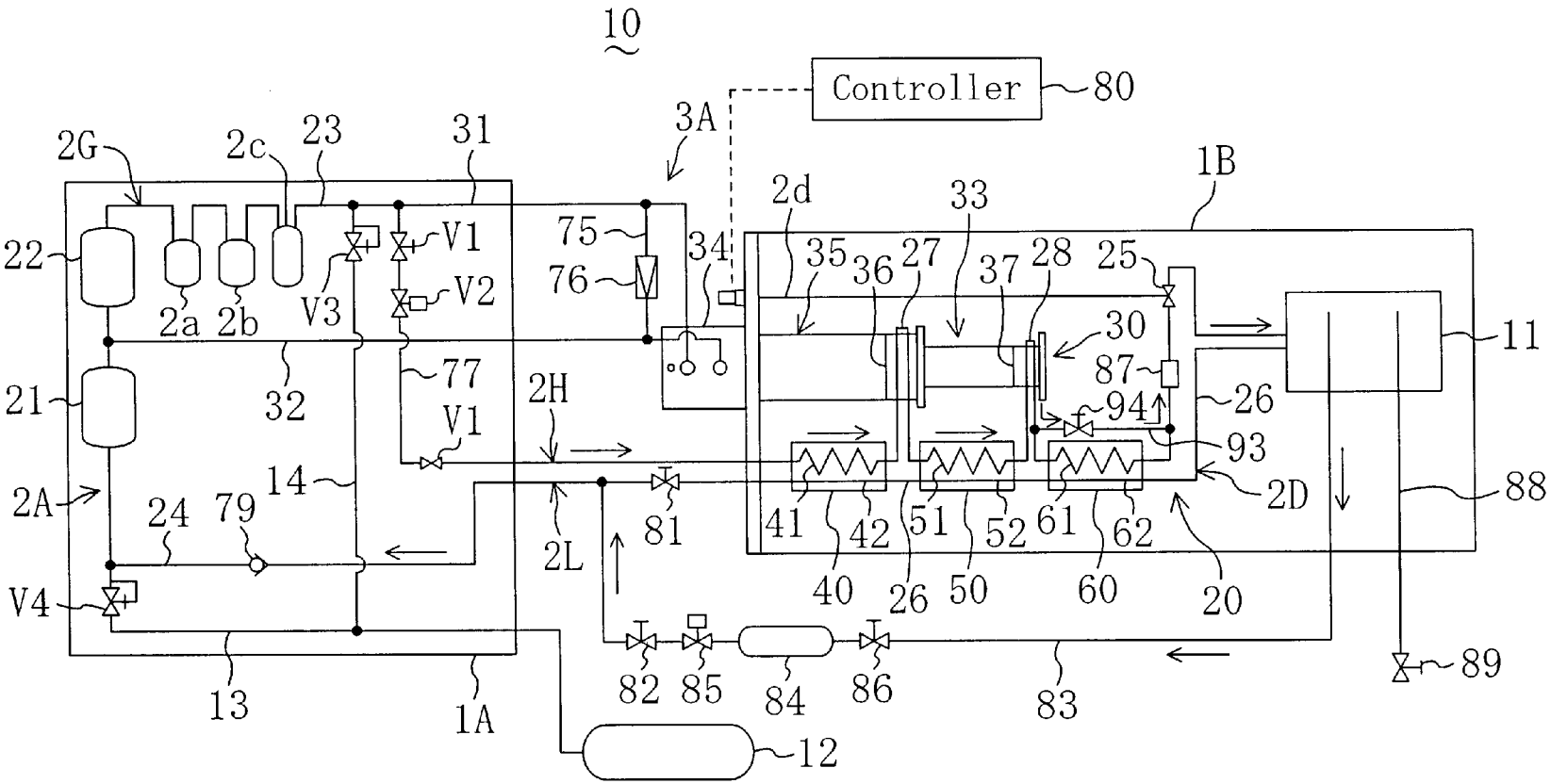
FIG. 7 is a refrigerant circuit diagram of a cryogenic refrigeration system according to Embodiment 3.

As illustrated in FIG. 7, the cryogenic refrigeration system (10) of Embodiment 3 includes a bypass pipe (93). One end of the bypass pipe (93) is connected between the second pre-cooling section (28) of the pre-cooling refrigerator (30) and the high pressure side passageway (61) of the third heat exchanger (60), and the other end thereof is connected between the high pressure side passageway (61) of the third heat exchanger (60) and the adsorber (87). A switching valve (94), which is closed during the cooling operation, is provided along the bypass pipe (93).

In the present embodiment, a clog elimination operation as follows can be performed, in addition to the clog elimination operation of Embodiment 1. Specifically, in the present clog elimination operation, the first switching valve (81) along the low pressure line (2L) of the JT circuit (2A) is closed, and the second switching valve (82) and the third switching valve (86) along the PL pipe (83) are opened. The JT valve (25) is fully opened, and the pre-cooling refrigerator (30) is turned OFF. The switching valve (94) along the bypass pipe (93) is opened.

The helium gas circulates as shown by a solid-line arrow in FIG. 7. Specifically, a portion of the high pressure helium gas discharged from the high pressure side compressor (22) flows along the high pressure line (2i) from the high pressure side passageway (41) of the first heat exchanger (40) to the first pre-cooling section (27), the high pressure side passageway (51) of the second heat exchanger (50), the second pre-cooling section (28), the bypass pipe (93) and then to the JT valve (25), after which the helium gas flows into the helium tank (11). Thereafter, a helium gas is passed into the low pressure pipe (24) from the helium tank (11) through the PL pipe (83), as in the clog elimination operation of Embodiment 1.

Thus, according to the present embodiment, it is possible to perform clog elimination exclusively for the first heat exchanger (40) and the second heat exchanger (50), whereby in a case where only the first heat exchanger (40) and the second heat exchanger (50) are clogged, the clog can be eliminated effectively. Moreover, such an operation does not cause a temperature increase in the third heat exchanger (60), whereby it is possible to quickly resume the cooling operation after completion of the clog elimination operation.

Figure 8:
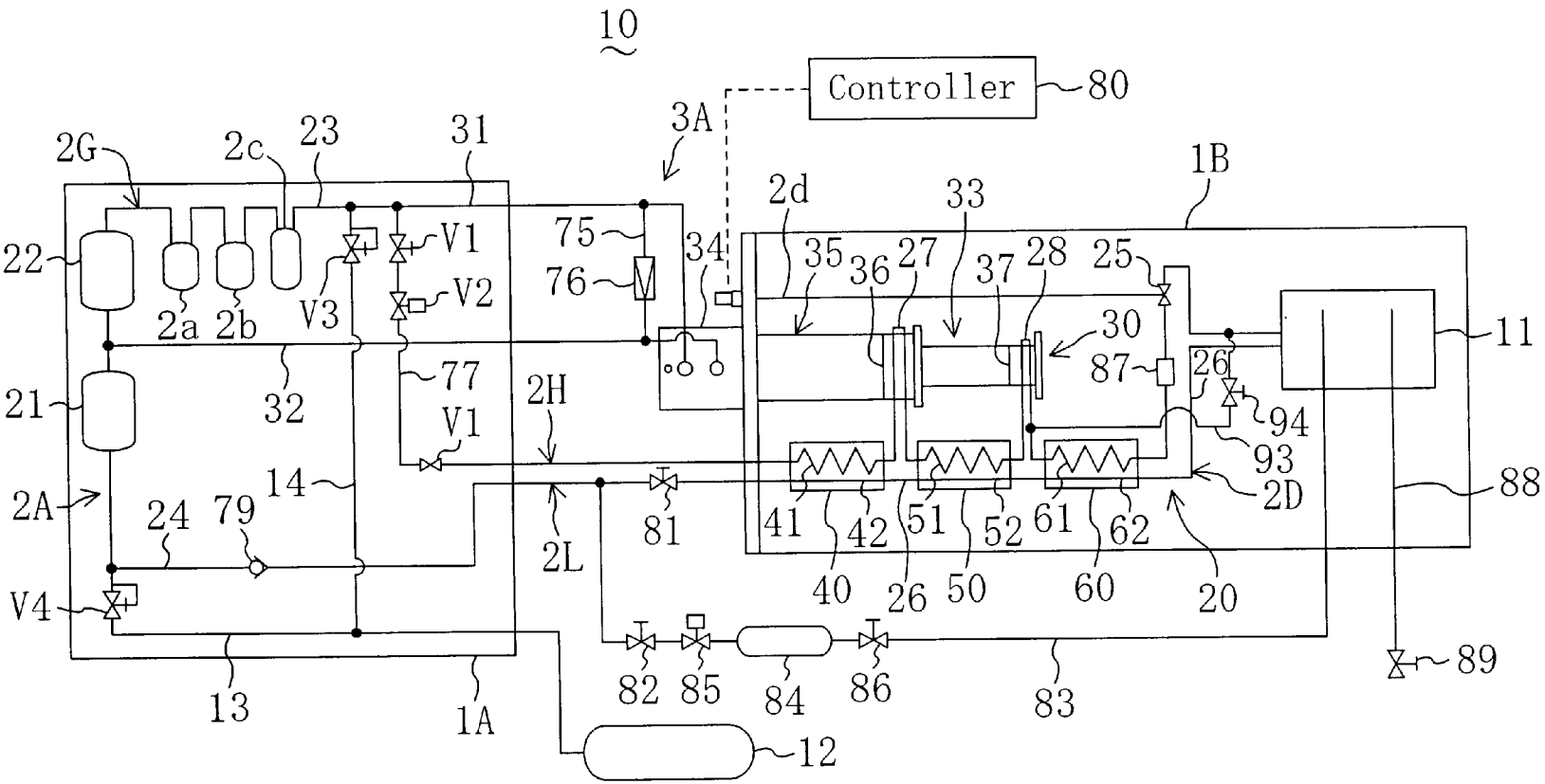
FIG. 8 is a refrigerant circuit diagram of a cryogenic refrigeration system according to a variation of Embodiment 3.
Figure 9:
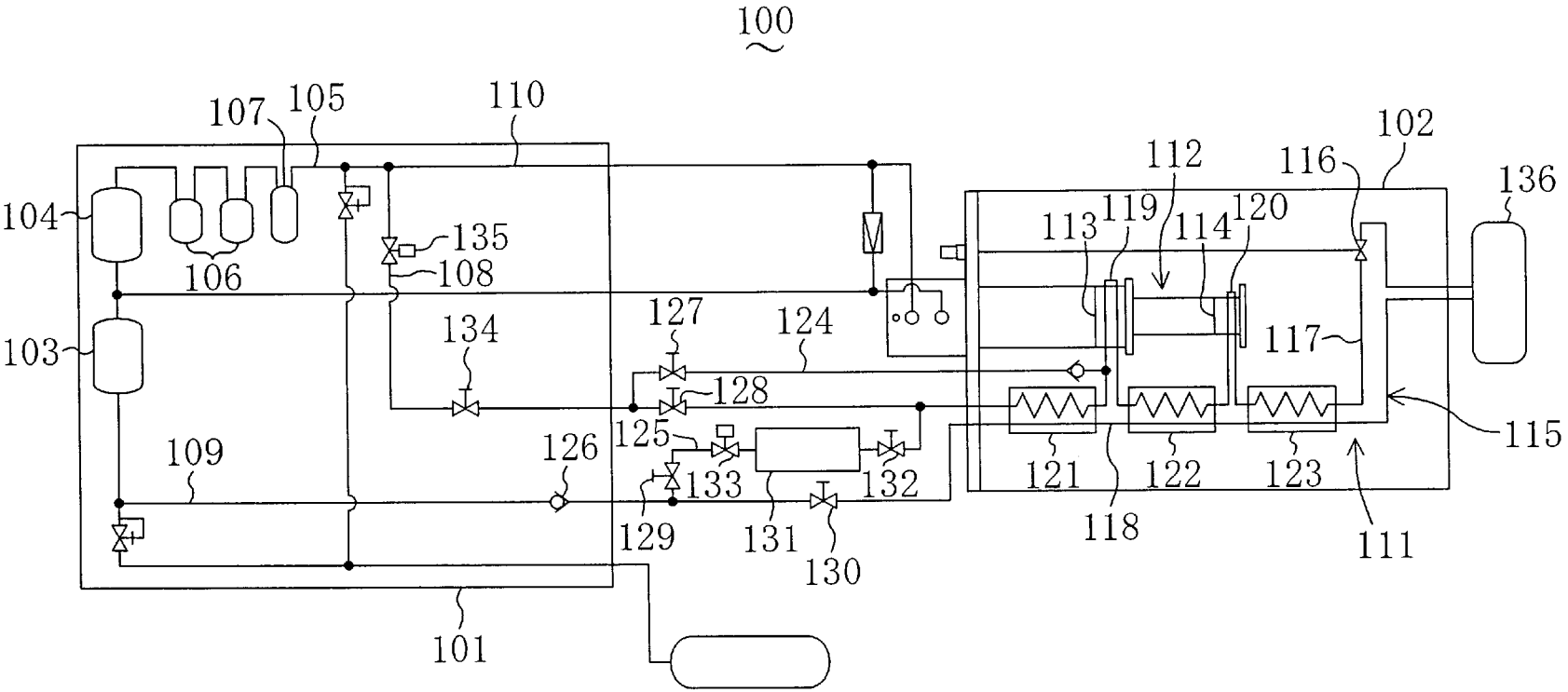
FIG. 9 is a refrigerant circuit diagram of a conventional cryogenic refrigeration system.

Note that the upstream end of the bypass pipe (93) may alternatively be connected between the high pressure side passageway (51) of the second heat exchanger (50) and the second pre-cooling section (28). Moreover, the downstream end of the bypass pipe (93) may alternatively be connected between the JT valve (25) and the helium tank (11), as illustrated in FIG. 8. Also with such alternative arrangements, the clog elimination operation as described above can be performed.

The present invention is not limited to the first to third embodiments set forth above, but may be carried out in various other ways without departing from the sprit or main features thereof Thus, the embodiments set forth above are merely illustrative in every respect, and should not be taken as limiting. The scope of the present invention is defined by the appended claims, and in no way is limited to the description set forth herein. Moreover, any variations and/or modifications that are equivalent in scope to the claims fall within the scope of the present invention.

What is claimed is:

1. A cryogenic refrigeration system, comprising:

a compressor;

a JT refrigerator including a JT valve through which a high pressure refrigerant gas discharged from the compressor is subjected to a Joule-Thomson expansion, and a refrigerant tank for storing the refrigerant, which has been liquefied by the Joule-Thomson expansion;

a first heat exchanger, including a high pressure side passageway through which the high pressure refrigerant gas discharged from the compressor is passed and a low pressure side passageway through which a low pressure refrigerant gas from the refrigerant tank is passed, for exchanging heat between the high pressure refrigerant gas in the high pressure side passageway and the low pressure refrigerant gas in the low pressure side passageway;

a pre-cooling refrigerator for pre-cooling the high pressure refrigerant gas, which has been cooled through the first heat exchanger, before the expansion through the JT valve;

a first switching valve provided on an outlet side of the low pressure side passageway of the first heat exchanger; and a gas refrigerant collecting pipe including a second switching valve therealong and connecting the refrigerant tank with a pipe on a suction side of the compressor, wherein a clog elimination operation is performed, during which the JT valve is opened while the first switching valve is closed and the second switching valve is opened so that the refrigerant discharged from the compressor is passed at least through the high pressure side passageway of the first heat exchanger and the JT valve into the refrigerant tank while the refrigerant gas in the refrigerant tank is collected through the gas refrigerant collecting pipe.

2. The cryogenic refrigeration system of claim 1, further comprising one or more heat exchanger, provided on a downstream side of the high pressure side passageway of the first heat exchanger, for exchanging heat between the high pressure refrigerant gas and the low pressure refrigerant gas.

3. The cryogenic refrigeration system of claim 1, further comprising:

a second heat exchanger and a third heat exchanger, provided on a downstream side of the high pressure side passageway of the first heat exchanger, for exchanging heat between the high pressure refrigerant gas and the low pressure refrigerant gas;

a bypass pipe having one end thereof connected between the high pressure side passageway of the first heat exchanger and a high pressure side passageway of the second heat exchanger and the other end thereof connected between a high pressure side passageway of the third heat exchanger and the JT valve; and a switching valve provided along the bypass pipe, wherein during the clog elimination operation, the switching valve of the bypass pipe is opened so that the refrigerant discharged from the compressor is passed through the high pressure side passageway of the first heat exchanger, the bypass pipe and the JT valve into the refrigerant tank.

4. The cryogenic refrigeration system of claim 1, further comprising:

a second heat exchanger and a third heat exchanger, provided on a downstream side of the high pressure side passageway of the first heat exchanger, for exchanging heat between the high pressure refrigerant gas and the low pressure refrigerant gas;

a bypass pipe having one end thereof connected between a high pressure side passageway of the second heat exchanger and a high pressure side passageway of the third heat exchanger and the other end thereof connected between the high pressure side passageway of the third heat exchanger and the JT valve; and a switching valve provided along the bypass pipe, wherein during the clog elimination operation, the switching valve of the bypass pipe is opened so that the refrigerant discharged from the compressor is passed through the high pressure side passageway of the first heat exchanger, the high pressure side passageway of the second heat exchanger, the bypass pipe and the JT valve into the refrigerant tank.

5. The cryogenic refrigeration system of claim 1, wherein an adsorber is provided along the gas refrigerant collecting pipe.

6. The cryogenic refrigeration system of claim 5, further comprising a third switching valve provided between the adsorber of the gas refrigerant collecting pipe and the refrigerant tank, wherein the third switching valve is opened during the clog elimination operation and closed otherwise.

7. The cryogenic refrigeration system of claim 1, wherein an adsorber is provided on an upstream side of the JT valve.

8. A cryogenic refrigeration system, comprising:

a compressor;

a JT refrigerator including a JT valve through which a high pressure refrigerant gas discharged from the compressor is subjected to a Joule-Thomson expansion, and a refrigerant tank for storing the refrigerant, which has been liquefied by the Joule-Thomson expansion;

a first heat exchanger, including a high pressure side passageway through which the high pressure refrigerant gas discharged from the compressor is passed and a low pressure side passageway through which a low pressure refrigerant gas from the refrigerant tank is passed, for exchanging heat between the high pressure refrigerant gas in the high pressure side passageway and the low pressure refrigerant gas in the low pressure side passageway;

a pre-cooling refrigerator for pre-cooling the high pressure refrigerant gas, which has been cooled through the first heat exchanger, before the expansion through the JT valve;

a first switching valve provided on an outlet side of the low pressure side passageway of the first heat exchanger;

a gas refrigerant collecting pipe including a second switching valve therealong and connecting the refrigerant tank with a pipe on a suction side of the compressor;

a second heat exchanger and a third heat exchanger, provided on a downstream side of the high pressure side passageway of the first heat exchanger, for exchanging heat between the high pressure refrigerant gas and the low pressure refrigerant gas; and a bypass pipe including a switching valve therealong and having one end thereof connected between the high pressure side passageway of the first heat exchanger and a high pressure side passageway of the second heat exchanger and the other end thereof connected between the JT valve and the refrigerant tank, wherein a clog elimination operation is performed, during which the JT valve is opened while the first switching valve is closed and the second switching valve and the switching valve of the bypass pipe are opened so that the refrigerant discharged from the compressor is passed through the high pressure side passageway of the first heat exchanger into the refrigerant tank while the refrigerant gas in the refrigerant tank is collected through the gas refrigerant collecting pipe.

9. The cryogenic refrigeration system of claim 8, wherein an adsorber is provided along the gas refrigerant collecting pipe.

10. The cryogenic refrigeration system of claim 9, further comprising a third switching valve provided between the adsorber of the gas refrigerant collecting pipe and the refrigerant tank, wherein the third switching valve is opened during the clog elimination operation and closed otherwise.

11. The cryogenic refrigeration system of claim 8, wherein an adsorber is provided on an upstream side of the JT valve.

12. A cryogenic refrigeration system, comprising:

a compressor;

a JT refrigerator including a JT valve through which a high pressure refrigerant gas discharged from the compressor is subjected to a Joule-Thomson expansion, and a refrigerant tank for storing the refrigerant, which has been liquefied by the Joule-Thomson expansion;

a first heat exchanger, including a high pressure side passageway through which the high pressure refrigerant gas discharged from the compressor is passed and a low pressure side passageway through which a low pressure refrigerant gas from the refrigerant tank is passed, for exchanging heat between the high pressure refrigerant gas in the high pressure side passageway and the low pressure refrigerant gas in the low pressure side passageway;

a pre-cooling refrigerator for pre-cooling the high pressure refrigerant gas, which has been cooled through the first heat exchanger, before the expansion through the JT valve;

a first switching valve provided on an outlet side of the low pressure side passageway of the first heat exchanger;

a gas refrigerant collecting pipe including a second switching valve therealong and connecting the refrigerant tank with a pipe on a suction side of the compressor;

a second heat exchanger and a third heat exchanger, provided on a downstream side of the high pressure side passageway of the first heat exchanger, for exchanging heat between the high pressure refrigerant gas and the low pressure refrigerant gas; and a bypass pipe including a switching valve therealong and having one end thereof connected between a high pressure side passageway of the second heat exchanger and a high pressure side passageway of the third heat exchanger and the other end thereof connected between the JT valve and the refrigerant tank, wherein a clog elimination operation is performed, during which the JT valve is opened while the first switching valve is closed and the second switching valve and the switching valve of the bypass pipe are opened so that the refrigerant discharged from the compressor is passed through the high pressure side passageway of the first heat exchanger and the high pressure side passageway of the second heat exchanger into the refrigerant tank while the refrigerant gas in the refrigerant tank is collected through the gas refrigerant collecting pipe.

13. The cryogenic refrigeration system of claim 12, wherein an adsorber is provided along the gas refrigerant collecting pipe.

14. The cryogenic refrigeration system of claim 13, further comprising a third switching valve provided between the adsorber of the gas refrigerant collecting pipe and the refrigerant tank, wherein the third switching valve is opened during the clog elimination operation and closed otherwise.

15. The cryogenic refrigeration system of claim 12, wherein an adsorber is provided on an upstream side of the JT valve.

* * * * *